US008150297B2

(12) United States Patent
Gayne et al.

(10) Patent No.: US 8,150,297 B2
(45) Date of Patent: Apr. 3, 2012

(54) GENEVA DRIVE AND LOCKING MECHANISM THEREFOR IN A TONER METERING MECHANISM FOR AN IMAGE FORMING APPARATUS

(75) Inventors: Jarrett Clark Gayne, Lexington, KY (US); Royden Thomas Kern, Lexington, KY (US); Asmund Vego, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 357 days.

(21) Appl. No.: 12/424,921

(22) Filed: Apr. 16, 2009

(65) Prior Publication Data

US 2010/0266315 A1 Oct. 21, 2010

(51) Int. Cl.
*G03G 15/08* (2006.01)

(52) U.S. Cl. ..... 399/260; 399/258

(58) Field of Classification Search ..... 399/258, 399/260, 262, 263
See application file for complete search history.

(56) References Cited

U.S. PATENT DOCUMENTS

| | | | | |
|---|---|---|---|---|
| 4,076,149 | A | 2/1978 | Saxinger | |
| 4,362,444 | A * | 12/1982 | Watkins | 408/17 |
| 4,650,097 | A * | 3/1987 | Hagihara et al. | 399/260 X |
| 5,139,176 | A * | 8/1992 | Reindl et al. | 399/260 X |
| 5,652,947 | A | 7/1997 | Izumizaki | |
| 5,797,061 | A | 8/1998 | Overall et al. | |
| 5,802,420 | A | 9/1998 | Garr et al. | |
| 6,510,291 | B2 | 1/2003 | Campbell et al. | |
| 6,600,882 | B1 | 7/2003 | Applegate et al. | |
| 6,718,147 | B1 | 4/2004 | Carter et al. | |
| 6,735,403 | B2 | 5/2004 | Kanno et al. | |
| 6,856,779 | B2 * | 2/2005 | Ota et al. | 399/262 |
| 7,088,943 | B2 * | 8/2006 | Iikura et al. | 399/260 |
| 7,187,876 | B2 * | 3/2007 | Ito et al. | 399/258 X |
| 7,389,072 | B2 | 6/2008 | Hebner et al. | |
| 7,433,632 | B2 | 10/2008 | Askren et al. | |
| 2002/0090230 | A1 | 7/2002 | Hatori et al. | |
| 2007/0183815 | A1 * | 8/2007 | Himes | 399/262 |
| 2008/0219709 | A1 | 9/2008 | Hebner et al. | |
| 2008/0292331 | A1 | 11/2008 | Yokomori et al. | |
| 2010/0247158 | A1 | 9/2010 | Nishiwaki | |

OTHER PUBLICATIONS

Non-final Office Action dated May 13, 2011 for related co-pending U.S. Appl. No. 12/424,905.

* cited by examiner

*Primary Examiner* — Sandra Brase
(74) *Attorney, Agent, or Firm* — John Victor Pezdek

(57) ABSTRACT

The present invention provides a toner container system, such as a toner cartridge, having a first reservoir for containing toner and a second reservoir for receiving toner from the first reservoir and transferring the toner to an image forming apparatus, and a toner transfer mechanism disposed between the first and second reservoirs, the transfer mechanism including a generally cylindrically shaped rotatable roller member having a plurality of equally spaced recesses disposed around the circumference thereof and being rotatable in angular increments wherein the recesses are alternately open to the first reservoir in a first position for each recess and open to the second reservoir in a second position for each recess, whereby toner is transferred from the first reservoir to the second reservoir upon rotation of the roller member, a Geneva drive mechanism including a drive gear operatively connected to the roller member for advancing the roller member in one angular increment for each complete rotation of the drive gear; and a locking mechanism operatively interconnecting the drive gear and rotatable member, whereby the drive gear is intermittently locked after each incremental angular advancement of the roller member to prevent actuation of the toner transfer mechanism while the rotatable member rotates through a recess at the second position thereof.

22 Claims, 5 Drawing Sheets

GENEVA DRIVE AND LOCKING MECHANISM THEREFOR IN A TONER METERING MECHANISM FOR AN IMAGE FORMING APPARATUS

CROSS REFERENCES TO RELATED APPLICATIONS

This patent application is related to the U.S. patent application Ser. No. 12/424,905, filed Apr. 16, 2009, entitled "Rotating Toner Cleaning Member For A Toner Delivery Device In An Image Forming Apparatus" and assigned to the assignee of the present invention.

BACKGROUND OF THE INVENTION

1. Field of the Invention

The present invention relates to image forming devices and to toner container structures therefor having a rotating toner transfer mechanism for transferring toner from a first region to a second region of the container structure, and more particularly to a rotating toner transfer member within the mechanism that includes a Geneva drive having a locking mechanism for preventing actuation of the toner transfer mechanism when the toner transfer member is being cleared of toner by movement of a rotatable member.

2. Description of the Related Art

Image forming devices including copiers, laser printers, facsimile machines, and the like, include a photoconductive drum having a rigid cylindrical surface that is coated along a defined length of its outer surface. The surface of the drum is charged to a uniform electrical potential and is selectively exposed to light in a pattern corresponding to an original image. The areas of the drum surface exposed to light are discharged and form a latent electrostatic image on the drum surface. Developer material, such as toner having an electrical charge, is attracted to the drum surface and is used for forming the toned image.

The toner is typically contained in structure such as a cartridge adjacent to the photoconductive drum for supplying the image forming material to a developer roller and to the photoconductive drum for forming a toned image on discharged portions of the photoconductive drum. A recording sheet, such as a blank sheet of paper, is then brought adjacent to the discharged photoconductive drum surface and the image forming material (toner) thereon is transferred to the recording sheet. The image forming material is then fuse the toner to the sheet using pressure and or heat. The toner is typically transferred to the developer roller from a working reservoir within the cartridge. A toner transfer mechanism transfers amounts of toner from a storage reservoir to the working reservoir when the system calls for additional toner.

Additional background information on the structure and operation of image forming devices and toner container structures and toner supply mechanisms disposed within image forming devices generally may be found in to U.S. Pat. No. 6,510,291 to Campbell et al., and to U.S. Patent Publication No. US 2008/0219709, by Hebner et al.

Toner container structures typically include a toner transfer mechanism having a rotatable toner transfer member that is cleared of toner by a rotatable member. In order to prevent interference between the toner transfer mechanism and the rotatable member, a mechanism for timely actuation of the toner transfer member is needed so that toner containing recesses on the toner transfer member are positioned so as to allow the rotatable member to clear the toner from the recesses.

SUMMARY OF THE INVENTION

The present invention provides a toner container system (such as a toner cartridge) having a toner delivery mechanism for delivering toner to the image forming mechanisms of an image forming apparatus wherein the toner transfer mechanism within the cartridge includes a toner transfer roller member incorporating a Geneva drive mechanism for selective rotation of the roller member in delivering measured amounts of toner to the image forming mechanism of an image forming apparatus, and a locking mechanism on the Geneva drive mechanism for preventing activation of the toner transfer mechanism when the roller member is being cleared of toner by a rotatable member.

The invention therefore relates to a toner container system for an image forming apparatus, comprising a first reservoir for containing toner, a second reservoir for receiving toner from said first reservoir, a toner transfer mechanism disposed between said first reservoir and said second reservoir for transferring toner from said first reservoir to said second reservoir and a Geneva drive mechanism. The toner transfer mechanism includes a generally cylindrically shaped rotatable roller member having a plurality of recesses disposed around a circumference thereof at equal angular increments, said roller member being rotatable in said angular increments whereby said recesses are alternately open to said first reservoir in a first position for each of said recesses and open to said second reservoir in a second position for each of said recesses, whereby toner is transferred from said first reservoir to said second reservoir upon rotation of said roller member. The Geneva drive mechanism includes a drive gear operatively connected to said roller member for rotatably advancing said roller member in one said angular increment for each complete rotation of said roller member so as to ensure proper location of said drive gear.

The invention also relates to a system for transferring image forming material from a first reservoir to a second reservoir for use with an image forming apparatus comprising a toner transfer mechanism including a generally cylindrically shaped rotatable roller member having a plurality of recesses disposed around a circumference thereof at equal angular increments, said roller member being rotatable in said angular increments whereby said recesses are alternately open to said first reservoir in a first position for each of said recesses and open to said second reservoir in a second position for each of said recesses, whereby toner is transferred from said first reservoir to said second reservoir upon rotation of said roller member, and a Geneva drive mechanism including a drive gear operatively connected to said roller member for rotatably advancing said roller member in one said angular increment for each complete rotation of said roller member so as to ensure proper location of said drive gear.

The invention further relates to a toner container system for an image forming apparatus comprising a housing including first reservoir for containing toner, and a second reservoir for receiving toner from said first reservoir, a toner transfer mechanism disposed between said first reservoir and said second reservoir, said toner transfer mechanism including a generally cylindrically shaped rotatable roller member having a plurality of recesses disposed around a circumference thereof at equal angular increments, said roller member being rotatable in said angular increments whereby said recesses are alternately open to said first reservoir in a first position for each of said recesses and open to said second reservoir in a second position for each of said recesses, whereby toner is transferred from said first reservoir to said second reservoir upon rotation of said roller member, a Geneva drive mechanism including a drive gear operatively connected to said roller member for rotatably advancing said roller member in one said angular increment for each complete rotation of said drive gear, a rotatable member disposed within said second reservoir for removing toner from each of said recesses, said rotatable member being sized and operatively disposed to rotate through each of said recesses at said second position thereof in response to each incremental angular advancement of said roller member, and a locking mechanism operatively interconnecting said drive gear and said rotatable member, whereby said drive gear is intermittently locked after each said incremental angular advancement of said roller member to prevent actuation of said toner transfer mechanism while said rotatable member rotates through a recess of said recesses at said second position thereof.

Advantageous aspects of the invention reside in consistent delivery of toner amounts through the toner transfer mechanism. The toner transfer roller of the toner transfer mechanism may be cleared of toner by a rotatable member sized to rotate through the toner containing recesses of the toner transfer roller. Use of the Geneva drive to control rotation of the toner transfer roller allows the roller to be advanced intermittently and held in selective positions to allow the rotatable member to sweep toner from the recesses of the roller without interference with the roller surfaces. The locking mechanism prevents activation of the toner transfer mechanism when the rotatable member would interfere with the toner transfer member. In one aspect of the invention, the locking mechanism is cam driven.

These and other attributes, aspects and advantages of the invention will become apparent as a detailed description of representative embodiments proceeds.

BRIEF DESCRIPTION OF THE DRAWINGS

Figure 1:
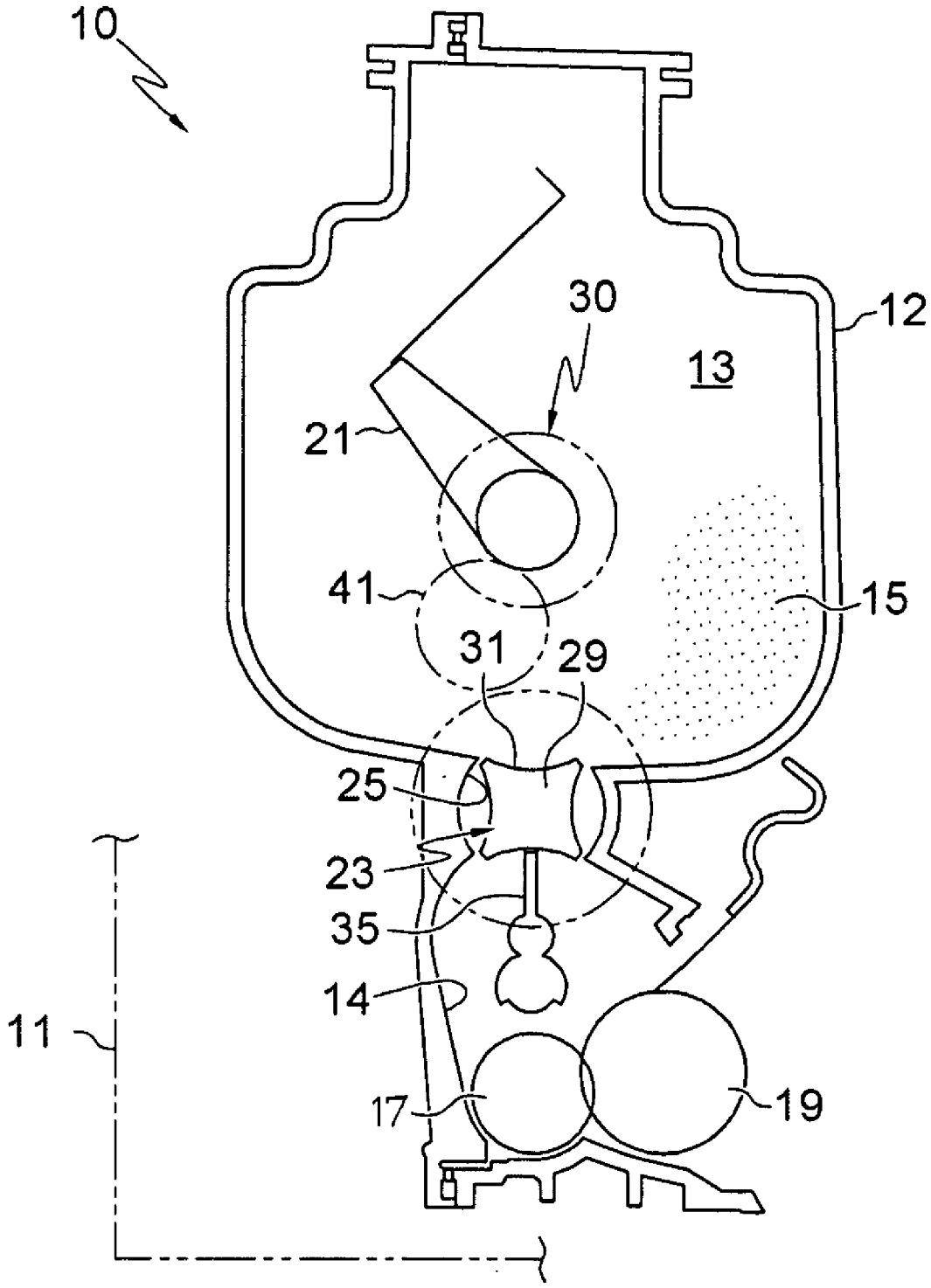
Figure 2:
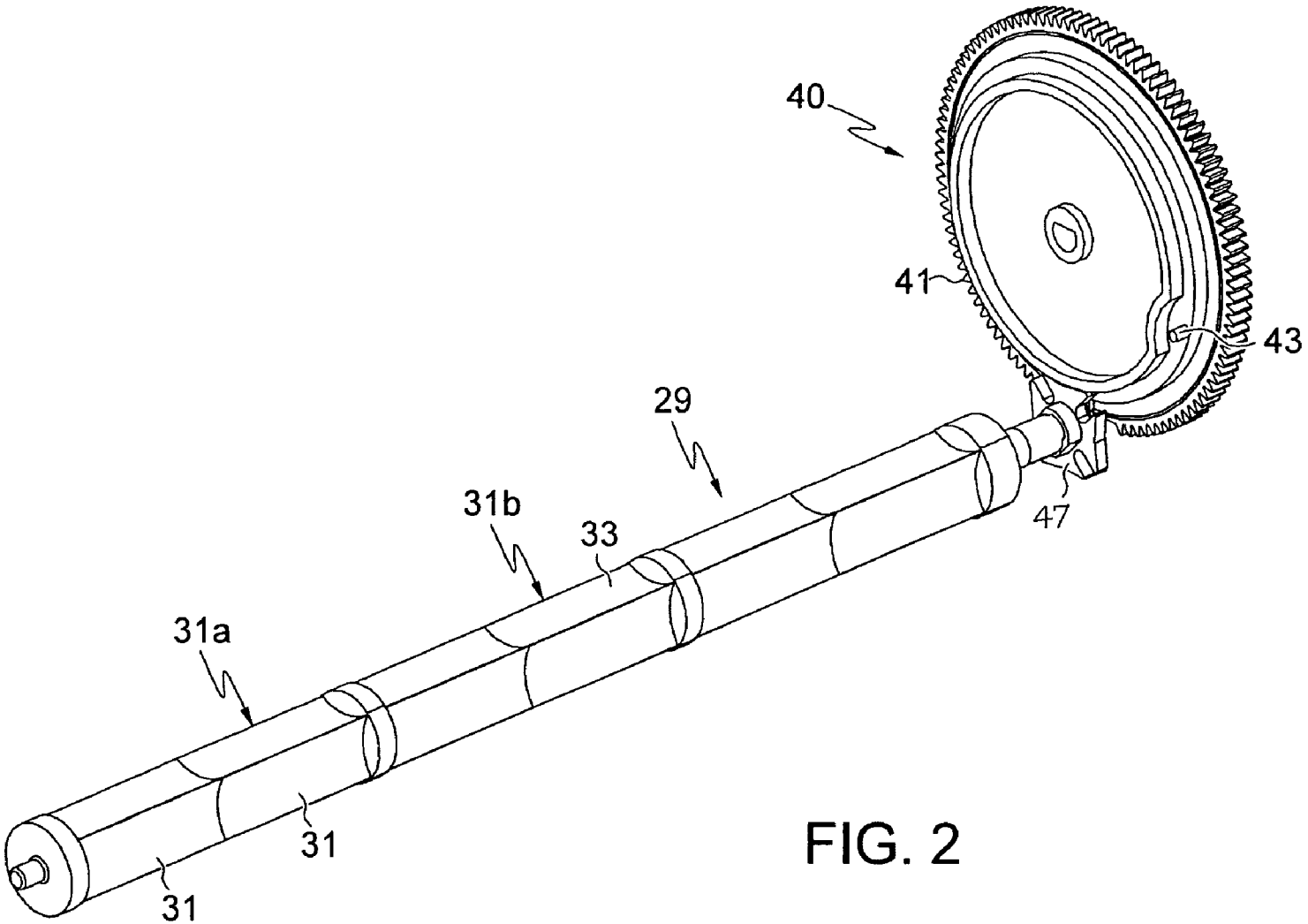
Figure 3:
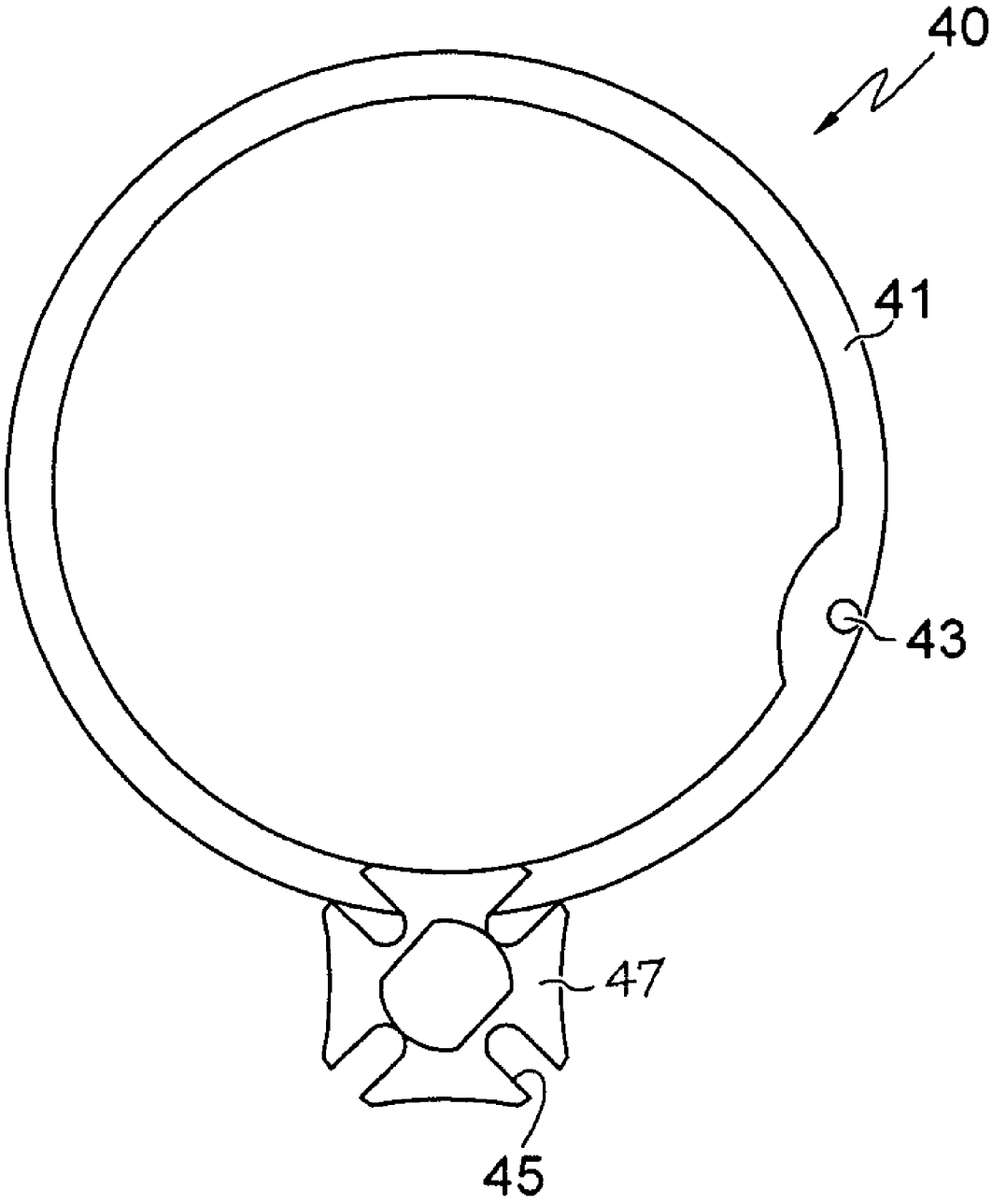
Figure 5:
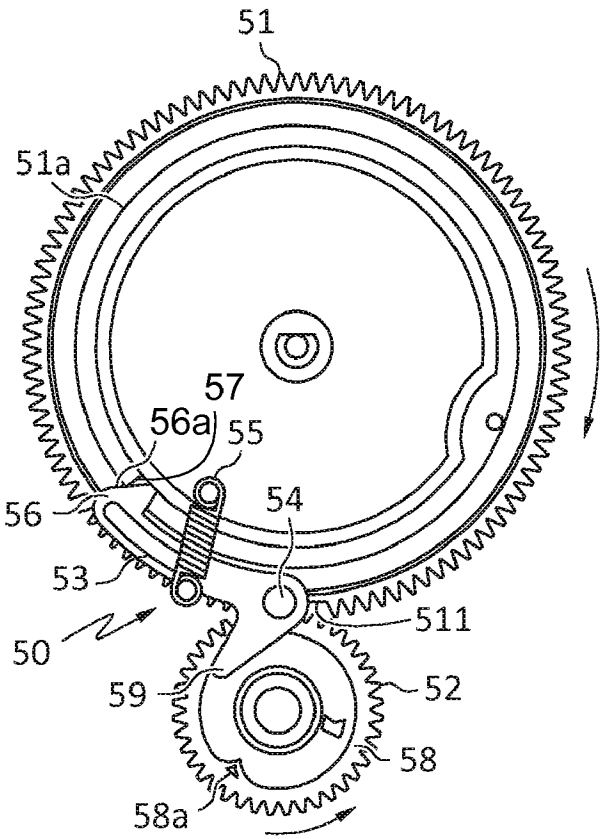
Figure 4:
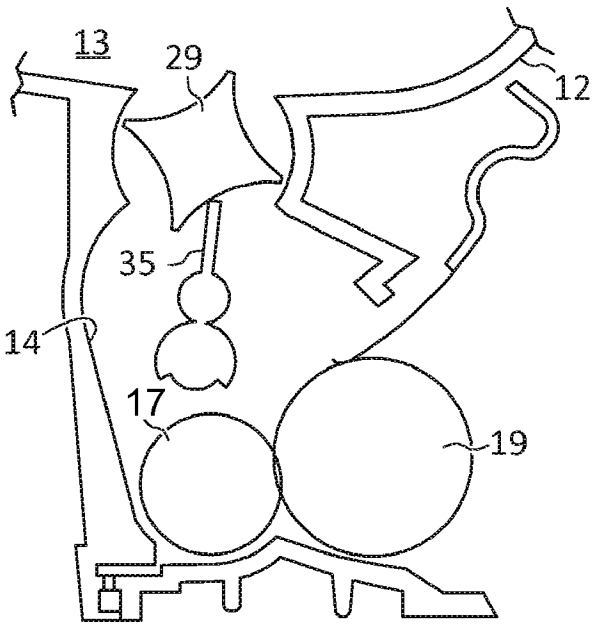
Figure 7:
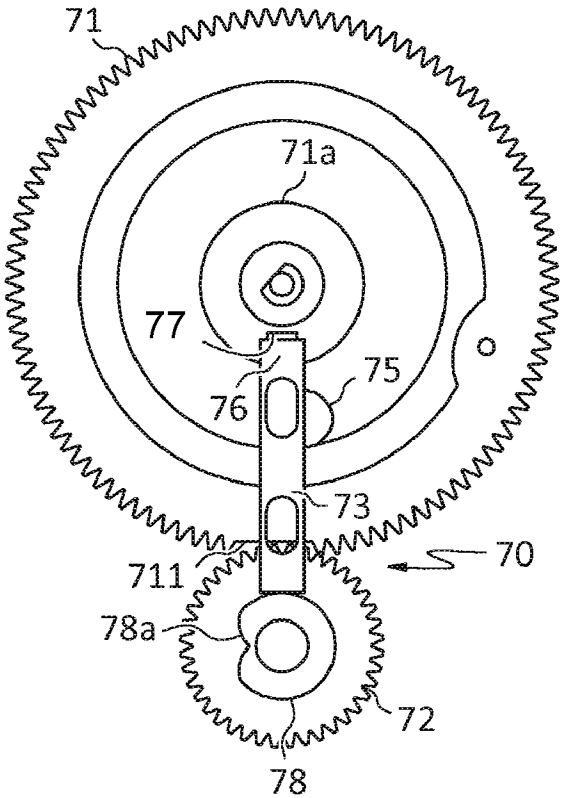
Figure 6:
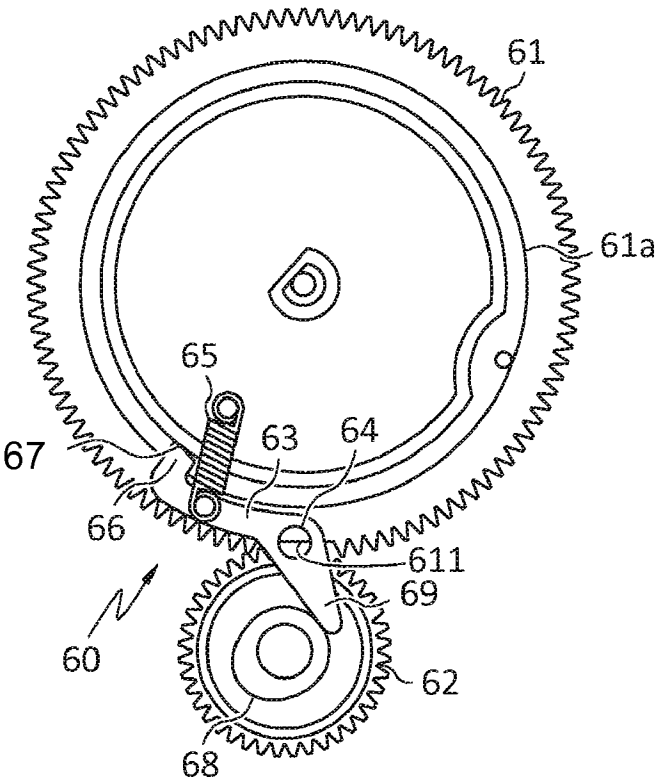

Having thus described the invention in general terms, reference is now made to the accompanying drawing figures that are not necessarily drawn to scale, and wherein:

FIG. 1 shows a sectional view of a toner container system as disposed within and forming a part of an image forming apparatus and to which the present invention may be effectively applied;

FIG. 2 is a perspective view of a toner roller member that may be included in the FIG. 1 structure including plural concave recessed regions in the roller surface, and being operatively attached to and driven by a Geneva drive mechanism having a locking mechanism according to the present invention;

FIG. 3 is an enlarged view of the Geneva drive mechanism that is operatively connected to and drives the toner roller member of the toner transfer mechanism of the FIG. 1 toner container system;

FIG. 4 is a view in section of a portion of the FIG. 1 system illustrating a condition of improper actuation timing of the rotatable member in relation to the toner roller member of the toner transfer mechanism of the FIG. 1 toner container system;

FIG. 5 illustrates one aspect of the locking mechanism according to the invention for the Geneva drive mechanism included in the toner transfer mechanism of the FIG. 1 toner container system;

FIG. 6 illustrates another aspect of the locking mechanism according to the invention for the Geneva drive mechanism included in the toner transfer mechanism of the FIG. 1 toner container system; and FIG. 7 illustrates a further aspect of the locking mechanism according to the invention for the Geneva drive mechanism included in the toner transfer mechanism of the FIG. 1 toner container system.

DETAILED DESCRIPTION

The present invention will now be described more fully hereinafter with reference to the accompanying drawing figures, in which some, but not all embodiments of the invention are shown. The invention may be embodied in many different forms and should not be construed as limited to the embodiments set forth herein; rather, these embodiments are provided so that this disclosure will satisfy applicable legal requirements.

The Campbell et al. '291 patent describes the basic elements and operation of the overall electrophotographic image forming process in a typical image forming apparatus utilizing a plurality of color cartridges. Specific reference is made to FIG. 1 of Campbell et al. '291 and the accompanying text briefly describing the structure and operation of a four cartridge color laser printer as a non-limiting exemplar of image forming devices generally using toner for printing with a photoconductor. Patent Publication No. US 2008/0219709 by Hebner et al. relates to a toner cartridge structure including a mechanism for conveying a quantity of image forming material (toner) between selected regions of the cartridge. The Hebner et al. mechanism includes a toner meter roller having one or more convex recesses in the roller surface for transferring toner from an upper to a lower region of the cartridge. In contrast to the Hebner et al. mechanism where a stationary wiper is utilized, a rotating wiper in the lower region aids in the removal of toner from the recesses.

Referring now to FIG. 1, shown therein is a sectional view of an exemplary toner container 10 system, such as a toner cartridge, to which the present invention may be applied, as disposed within and forming a part of an image forming apparatus 11. Toner container 10 generally comprises a housing 12 defining therewithin two reservoirs, namely first upper (storage) reservoir 13 and second lower (working) reservoir 14 for supplying image forming material, such as toner 15, to a toner adder roller 17, which in turn supplies toner to an image developer roller mechanism 19 which then supplies toner to a photoconductive drum (not shown) within image forming apparatus 11. Upper reservoir 13 may include paddles or agitators, represented in FIG. 1 by paddle 21, for agitating toner 15 in reservoir 13 to facilitate transfer of toner to lower reservoir 14.

Container 10 may be structured to contain black toner for a black only image forming apparatus (such as a printer). More typically, however, container 10 may comprise one of a plurality of similarly structured toner containers, such as the various toner cartridges included in a color image forming apparatus, all of which cartridges are generally of similar construction but distinguished by the toner color contained therein. A typical color image forming apparatus may include individual cartridges including respective toner colors of black, magenta, cyan, and yellow, each respective color forming an individual image of a single color that is combined in layered fashion with the other colors to create the final multicolored image. Toner container 10 (and each of the other toner containers included in the image forming apparatus) may include an image developer roller mechanism 19 that operatively contacts the photoconductive drum within an image forming apparatus 11.

In the toner container 10 system, movement of toner 15 from reservoir 13 to reservoir 14 may be facilitated using a geared toner supply mechanism having any suitable structure as would occur to the skilled artisan practicing the invention such as represented in dashed lines as toner transfer mechanism 30, along with attached paddle 21 within reservoir 13 for agitating and moving toner 15 into toner transfer mechanism 23, such as described in the Campbell et al. '291 patent or in the Hebner et al. publication. As would also occur to a skilled artisan, housing 12 may be split into two housings each containing a toner reservoir and one of which would contain the toner transfer mechanism 23, that would be detachably mounted together. Alternatively, both reservoirs could be detachably mounting to the toner transfer mechanism.

In one aspect of the invention, toner transfer mechanism 23 may include toner roller member 29 such as shown in the representative structure depicted in perspective in FIG. 2. Paddle 21 may be sized to extend substantially the length of toner container 10 and to rotate closely to the walls of reservoir 13 so as to agitate and prevent clumping of toner 15. Paddle 21 may otherwise be configured for the intended purpose as would occur to the skilled artisan.

A toner transfer meter roller mechanism 23 is disposed within an intermediate region 25 between upper reservoir 13 and lower reservoir 14. Roller mechanism 23 is configured to supply toner 15 from reservoir 13 to reservoir 14 when the system calls for toner, as through a toner level sensing device 35 disposed within reservoir 14. The toner sensing device may be of any conventional type known in the applicable art as would be selected by one skilled in the art for inclusion in the overall container 10 structure. Roller mechanism 23 includes a toner meter roller member 29 shown separately in the perspective view (not to scale) in FIG. 2. Toner meter roller member 29 is structured so as to facilitate the transfer of measured amounts of toner 15 from upper reservoir 13 to lower reservoir 14.

With reference now to FIG. 2 in conjunction with FIG. 1, it is seen that roller member 29 typically is generally cylindrical in shape, about 10 to about 30 mm in diameter (i.e., a radius of curvature of about 5 to 15 mm). Roller member 29 includes one or more axially and circumferentially spaced concave recesses 31 defined in the cylindrical surface thereof by concave surfaces 33 in the general shape of a pocket defining a cylindrical section. Concave surfaces 33 may preferably be defined by a radius of curvature. The radius of curvature of concave surfaces 33 may be about 0.75 to 3.0 times the radius of curvature of roller 29. Selection of the curvature of roller 29 relative to the curvature of convex surfaces 33 may be made by one skilled in the applicable art practicing the invention, the specific selection not considered limiting of the invention or of the appended claims.

Recesses 31 typically are defined in one or more sets such as shown as sets 31*a* and 31*b*. The sets 31*a*, 31*b* are typically aligned axially along the surface of roller member 29, with each set 31*a*, 31*b* including a selected plurality of circumferentially and equally spaced recesses 31 around the circumferential surface of roller member 29 and defining the cross section such as shown in FIG. 1 as including a plurality of four recesses in each set. Accordingly, upon rotation of roller member 29, each recess 31 is positioned alternately at a first position open to reservoir 13 where it is filled with toner 15 and at a second position open to reservoir 14 where the toner is removed from recesses 31. Substantially complete removal of toner from recesses 31 and the transfer of consistent amounts of toner with each rotation of roller member 29 are accomplished using a rotatable wiper member 35 within reservoir 14. Roller member 29 is structured and operated to rotate past rotatable member 35 intermittently as rotatable member 35 rotates in order to remove toner from the toner bearing recesses 31, as each recess 31 is alternately open to reservoir 14. In one aspect of the invention, in the operation of container 10, member 35 may be structured and operated to be continually rotating.

In order for roller member 29 to rotate past rotatable member 35 so as to clear toner from recesses 31, roller member 29 must be held in position momentarily such as depicted in FIG. 1. The gap between the distal end of member 35 and the surfaces 33 of recesses 31 should be kept to a minimum to maximize the amount of the volume of recesses 31 swept by rotatable member 35 and to avoid substantial physical contact between rotatable member 35 and roller member 29. Rotatable member 35 may include a flexible distal end so as to preclude interference with or damage to surfaces 33. The process of removing toner from the toner bearing recesses 31 of roller member 29 may be particularly desirable if toner 15 has poor flow properties so as to accumulate on the surfaces 33 of recesses 31. Such accumulation could result in inconsistent toner delivery and a consequent inaccurate gauging of overall toner consumption.

Referring now to FIG. 2 in conjunction with FIG. 3, it is seen that a Geneva drive mechanism 40 is, according to an aspect of the invention, in operative engagement with roller member 29 in order to rotate roller member 29 through selected angular increments in order to supply toner 15 through toner transfer mechanism 23 (FIG. 1), such as upon a command for toner by the toner sensing device. Geneva drive mechanism 40 includes a drive wheel 41 which in an exemplary embodiment of the invention may form a part of geared toner transfer mechanism 30 within toner container 10. Drive wheel 41 includes near the periphery thereof a pin 43 for engaging slots 45 of driven wheel 47 of drive mechanism 40. Driven wheel 47 is attached to roller member 29 as suggested in FIG. 3 for rotation therewith. In one aspect of the invention, driven wheel 47 includes four slots 45 equally spaced around the circumference of driven wheel 47. The number of slots 45 correspond to the number of recesses 31 disposed around the circumference of roller member 29 so that each incremental angular advancement of driven wheel 47 rotates roller member 29 an identical incremental angular displacement. As suggested below, driven wheel 47 may comprise any of various pluralities of slots 45, and roller member 29 will include a corresponding number of recesses in each set 31*a*, 31*b*.

In the operation of the Geneva drive mechanism 40 as depicted in FIG. 2 and FIG. 3, driven wheel 47 is advanced by one increment of 90 degrees for each full rotation of drive wheel 41 by the engagement of pin 43 with slots 45. Rotation of drive wheel 41 may be commanded by a call by the sensing device for toner to be transferred through toner transfer mechanism 23 to reservoir 14. With each rotation of drive wheel 41, toner 15 that is contained in one group of axially aligned recesses 31 on roller member 29 will be transferred to reservoir 14. The structure and operation of drive wheel 41 may be selected to provide an interval between each subsequent engagement of pin 43 with driven wheel 47 that allows member 35 to rotate through recesses 31 so as to clear toner therefrom.

In Geneva drive mechanism 40 as shown, driven wheel 47 includes four slots 45 equally spaced around the circumference of driven wheel 47. The number of slots 45 correspond to the number of recesses 31 in each set of recesses disposed around the circumference of roller member 29 so that each incremental angular advancement of driven wheel 47 rotates roller member 29 an identical incremental angular displacement. The Geneva drive may comprise other pluralities of slots circumferentially defined around driven wheel 47, including 3, 5, 6 or more slots, as a particular application would require. For example, for a driven wheel 47 containing three slots 45, each rotation of drive wheel 41 advances roller member 29 through 120 degrees, and for a driven wheel 47 containing five slots 45, each rotation of drive wheel 41 advances roller member 29 through 72 degrees, and for a driven wheel 47 containing six slots 45, each rotation of drive wheel 41 advances roller member 29 through 60 degrees. The number and spacing of recesses 31 disposed in sets 31*a* and 31*b* around the circumference and along the length of roller member 29 would be selected to correspond to the selected number of slots 45 in driven wheel 47.

In operation of the Geneva drive mechanism 40 of FIG. 2 and FIG. 3 for incremental rotation of roller member 29, actuation of roller member 29 must be timed with rotatable member 35 so that the two components will not collide. Referring now to FIG. 4, shown therein is a view in section of a portion of the FIG. 1 system illustrating a condition of improper actuation timing of rotatable member 35 in relation to roller member 29. If roller member 29 and rotatable member 35 are rotating as a gear train relative to each other, rotatable member 35 will not properly sweep recesses 31 of roller member 29. If both components are rotating in the same direction, counter-clockwise in FIG. 4, the rotatable member 35 will collide with roller member 29 as suggested in FIG. 4.

In accordance with a principal feature of the invention herein, a locking mechanism is provided to prevent actuation of roller member 29 to a position where roller member 29 and rotatable member 35 collide or interfere. Accordingly, the condition illustrated in FIG. 4 is obviated by a locking mechanism that locks geared toner transfer mechanism 30 and Geneva drive mechanism 40 in an operating position when roller member 29 is not actuated. Roller member 29 may then be actuated intermittently when it is in a position at which it will not interfere with rotatable member 35.

Referring now to FIG. 5 shown therein is one aspect of the invention in the form of a locking mechanism 50 for the Geneva drive mechanism 40 of the FIG. 1 toner container 10 system. In locking mechanism 50, Geneva drive gear 51 operatively interacts with the drive gear 52 that drives rotatable member 35 with a spring biased cam follower 53. Cam follower 53 is pivotally mounted as at pivot point 54 intermediate the first and second ends of cam follower 53. Cam follower 53 is biased toward Geneva drive gear 51, such as to the position shown in FIG. 5, by a bias spring 55. In the condition shown in FIG. 5, an appendage 56 on a first end of cam follower 53 engages a slot 57 in a surface 51*a* on drive gear 51, which defines a locked condition for drive gear 51. In the locked condition, Geneva drive gear 51 is prevented from rotating. Drive gear 52 typically drives rotatable member 35 continuously, and in the exemplary structure shown in FIG. 5 rotates in a counter-clockwise direction as FIG. 5 is viewed. Geneva drive gear 51 controls the rotation of roller member 29 and rotates in a clockwise direction. Drive gear 52 tracks the location of rotatable member 35.

In the embodiment shown in FIG. 5, a cam surface 58 is defined on an outer surface on drive gear 52 and operatively contacts appendage 59 on a second end of cam follower 53. As rotatable member 35 rotates continuously, cam contour portion 58*a* on cam surface 58 intermittently contacts and deflects appendage 59 and thereby pivots cam follower 53 which results in the withdrawal of appendage 56 from slot 57. Geneva drive gear 51 is thereby momentarily released from the locked condition shown in FIG. 5 and is able to be actuated should the level sensing device call for toner in the lower reservoir 14. If the level sensing device calls for toner and the drive gear 52 engages drive gear 51, then the cam contour portion 58*a* on drive gear 52 rotates past appendage 59 thereby allowing bias spring 55 to urge appendage 56 against surface 51*a* of drive gear 51.

In another aspect of the invention, it is seen in FIG. 5 that drive gear 51 has a short sector 511 comprising a gap in the gear teeth on the periphery of drive gear 51. At the position of drive gear 51 as shown in FIG. 5 at which drive gear 52 is positioned next to sector 511, drive gear 52 can rotate continuously out of engagement with drive gear 51 while drive gear 51 remains stationary. The short sector 511 has clearance on each side to ensure that the drive gear 51 will not come in contact with drive gear 52. When toner is called for, the toner sensing device actuates drive gear 51 into engagement with drive gear 52 and drive gear 51 is driven clockwise one rotation. When the short sector 511 is reached, the drive gear 51 comes out of engagement with drive gear 52. The clearance designed into the short sector 511 means that the drive gear 51 is not in the parked position. The backlash in the system will pull the drive gear 51 in a counterclockwise rotation back into engagement with the drive gear 52 and the gears will make a clicking noise. The inclined edge 56*a* on appendage 56 allows gear 51 to be driven to the condition shown in FIG. 5 where sector 511 is again centered and appendage 56 again engages slot 57, and the Geneva drive mechanism is again in a locked position.

The timing of the Geneva drive locking mechanism of the FIG. 5 embodiment as well as the locking mechanisms described below in relation to the embodiments shown in FIG. 6 and FIG. 7 is tied to the timing of the rotation of the drive gear for rotatable member 35 so that when rotatable member 35 is rotating away from roller mechanism 23 (see FIG. 1), the Geneva drive gear is momentarily free to rotate so as to advance roller member 29 through a one-quarter rotation (for the representative roller 29 configuration illustrated in FIG. 1 and FIG. 2 and the Geneva drive configuration shown in FIG. 3). Accordingly, when rotatable member 35 would collide or interfere with roller member 29, the Geneva drive gear is locked in place to prevent actuation of roller member 29. When rotatable member 35 would not collide with roller member 29, that is, when member 35 is rotating away from roller mechanism 23, Geneva drive mechanism 40 is unlocked so as to actuate roller member 29. In each of the embodiments described, the locking mechanism should remain in the unlocked position when the drive gear for paddle 21 (FIG. 1) is rotating.

Referring now to FIG. 6, shown therein is another aspect of the invention in the form of locking mechanism 60 for the Geneva drive mechanism 40 of the FIG. 1 toner container 10 system. Similarly to the FIG. 5 mechanism, in locking mechanism 60, Geneva drive gear 61 operatively interacts with the drive gear 62 that drives rotatable member 35 with a spring biased cam follower 63. Cam follower 63 is pivotally mounted as at pivot point 64 intermediate the first and second ends of cam follower 63. Cam follower 63 is biased toward Geneva drive gear 61, such as to the position shown in FIG. 6, by a bias spring 65. In the condition shown in FIG. 6, an appendage 66 on a first end of cam follower 63 engages a slot 67 in a surface 61*a* on drive gear 61, which defines a locked condition for drive gear 61. In the locked condition, Geneva drive gear 61 is prevented from rotating. Drive gear 62 typically drives rotatable member 35 continuously, and in the exemplary structure shown in FIG. 6 rotates in a counter-clockwise direction as FIG. 6 is viewed. Geneva drive gear 61 controls the rotation of roller member 29 and rotates in a clockwise direction. Drive gear 62 tracks the location of rotatable member 35. In the embodiment shown in FIG. 6, an eccentric cam surface 68 is defined the inside edge of drive gear 62. Appendage 69 on a second end of cam follower 63 rides on and follows cam surface 68. As rotatable member 35 continuously rotates, cam surface 68 intermittently urges follower 63 to pivot around pivot point 64 which results in the withdrawal of appendage 66 from slot 67. Geneva drive gear 61 is thereby momentarily released from the locked condition of FIG. 6 and is able to be actuated should the level sensing device call for toner in the lower reservoir 14. If the level sensing device calls for toner and the drive gear 62 engages drive gear 61, then the cam surface 68 continues to rotate and allow bias spring 65 to urge appendage 66 against surface 61*a* of drive gear 61. Drive gear 61 then rotates to the condition shown in FIG. 6 where appendage 66 again engages slot 67 upon the one full rotation of Geneva drive gear 61, and the Geneva drive mechanism is again in a locked condition.

It is further noted that drive gear 61 has a short sector 611 comprising a gap in the gear teeth on the periphery of drive gear 61 for operation with respect to gear 62 similarly to that described above for mechanism 50 of FIG. 5. This functionality would require a cam surface or inclined surface on appendage 66 (not shown in FIG. 6).

Referring now to FIG. 7, shown therein is yet a further aspect of the invention in the form of locking mechanism 70 for the Geneva drive mechanism 40 of the FIG. 1 toner container 10 system. In locking mechanism 70, Geneva drive gear 71 operatively interacts with the drive gear 72 that drives rotatable member 35 with a spring biased linearly acting cam follower 73. Cam follower 73 is biased away from Geneva drive gear 71 by a bias spring 75. In the condition shown in FIG. 7, a first end 76 of cam follower 73 engages a slot 77 in a surface 71*a* on drive gear 71, which defines a locked condition for drive gear 71. In the locked condition, Geneva drive gear 71 is prevented from rotating. Drive gear 72 typically drives rotatable member 35 continuously, and in the exemplary structure shown in FIG. 7 rotates in a counter-clockwise direction as FIG. 7 is viewed. Geneva drive gear 71 controls the rotation of roller member 29 and rotates in a clockwise direction. Drive gear 72 tracks the location of rotatable member 35. In the embodiment shown in FIG. 7, a disk cam surface 78 is disposed on an outer edge of drive gear 72 and operatively contacts a second end of cam follower 73. As rotatable member 35 rotates continuously, cam contour portion 78*a* on cam surface 78 in contact with the second end of cam follower 73 intermittently allows cam follower 73 to withdraw from slot 77 under the bias of spring 75. Geneva drive gear 71 is thereby momentarily released from the locked condition shown in FIG. 7 and is able to be actuated should the level sensing device call for toner in the lower reservoir 14. If the level sensing device calls for toner and the drive gear 72 engages drive gear 71, then the cam contour portion 78*a* on drive gear 72 rotates past cam follower 73 while drive gear 71 rotates and first end 76 of cam follower 73 follows against surface 71*a* of drive gear 71. Drive gear 71 rotates to the condition shown in FIG. 7 where first end 76 again engages slot 77 upon the one full rotation of Geneva drive gear 71, and the Geneva drive mechanism is again in a locked condition.

It is again noted that in mechanism 70, similarly to the mechanism 50 and mechanism 60 of FIG. 5 and FIG. 6, drive gear 71 has a short sector 711 comprising a gap in the gear teeth on the periphery of drive gear 71 for operation with respect to gear 72 similarly to that described above for mechanisms 50 and 60. This functionality would require a cam surface on the surface of first end 76 (not shown in FIG. 7).

In each of the foregoing described embodiments of the invention, locking mechanisms for the Geneva drive mechanism were described as cam driven. A principal function of the exemplary locking mechanisms described herein to intermittently lock the Geneva drive mechanism to prevent actuation of the toner roller mechanism 23 when the rotatable member 35 would collide with the toner roller mechanism may be performed by other structures or mechanisms not specifically described herein. Other cam driven structures as well as other locking mechanisms that would perform the function as would occur to the skilled artisan in consideration of and guided by these teachings are considered within the scope of these teachings and the appended claims.

Referring again to FIG. 3, it is noted that recesses 31 of roller member 29 typically are of known volumetric size to facilitate transfer of measured amounts of toner 15 from reservoir 13 to reservoir 14 with each incremental angular advancement of roller member 29. Accordingly, toner consumption from cartridge 10 may be monitored and approximated by counting the rotations of roller member 29 using associated hardware or software (not shown).

Roller member 29 may typically comprise a material such as high impact polystyrene, acetol, metals or similar materials as would occur to the skilled artisan guided by these teachings. Judicious selection of roller member 29 structure and material composition and recess 31 configuration may facilitate relatively smooth engagement with a wiper 35 upon rotation of roller member 29.

Rotatable member 35 may be formed from any suitable material as would occur to one skilled in the applicable art guided by these teachings, such as a metal (including stainless steel) in thickness of from about 0.001 to about 0.003 inch, or a polymeric material, such as a thermoplastic or thermoset type material, such as extrusions of the thermoplastic polyester such as MYLAR, in thicknesses from about 0.003 to about 0.020 inch, or other thermoplastics including polyesters, polycarbonates, polysulphones, polyvinyl chloride, or thermoplastic elastomers, including polyurethane or polyester type elastomers. It is understood, however, that the specific selected sizes, structure and composition of member 35 are not intended to be limited to the exemplary embodiments specifically described herein.

It is noted further that each toner container in an image forming apparatus having multiple toner containers (cartridges) each containing a respective toner color may be structured substantially as described above for container 10.

Another aspect of the invention may be embodied in an image forming apparatus 11 wherein toner transfer mechanism 23 and lower reservoir 14 are structured as elements of the image forming apparatus 11 itself. In this arrangement, reservoir 13 containing the original charge of toner 15 may be insertable into apparatus 11 as a separate unit and operatively engage toner transfer mechanism 23 in substantially similar manner to that depicted in the accompanying drawing figures.

The invention therefore provides a toner container system, such as a toner cartridge, wherein the toner transfer roller mechanism within the cartridge includes a toner transfer roller member incorporating a Geneva drive for selective incremental angular advancement of the toner transfer roller member and a locking mechanism on the Geneva drive for preventing actuation of the toner transfer mechanism when the roller member is being cleared of toner by a rotatable member. It is understood that the invention may be practiced in ways other than as specifically set forth herein without departing from the scope and essential characteristics of the invention. The description of several embodiments of the invention as herein presented is therefore intended for purposes of illustration. It is not intended to be exhaustive or to limit the invention to the precise forms disclosed, and obviously many modifications and variations are possible in light of the above teachings. It is intended that the scope of the invention be defined by the claims appended hereto.

We claim:

1. A toner container system for an image forming apparatus comprising:

a first reservoir for containing toner;

a second reservoir for receiving toner from said first reservoir; and a toner transfer mechanism disposed between said first reservoir and said second reservoir for transferring toner from said first reservoir to said second reservoir; said toner transfer mechanism including:

a generally cylindrically shaped rotatable roller member having a plurality of recesses disposed around the circumference thereof at equal angular increments, said roller member being rotatable in said angular increments whereby said recesses are alternately open to said first reservoir in a first position for each of said recesses and open to said second reservoir in a second position for each of said recesses, whereby toner is transferred from said first reservoir to said second reservoir upon rotation of said roller member;

a Geneva drive mechanism including a drive gear operatively connected to said roller member for rotatably advancing said roller member in one said angular increment for each complete rotation of said drive gear; and a rotatable member disposed within said second reservoir for removing toner from each of said recesses, said rotatable member being sized and operatively disposed to rotate through each of said recesses at the second position thereof in response to each incremental angular advancement of said roller member.

2. The toner container system of claim 1 further comprising a locking mechanism operatively interconnecting said drive gear and said rotatable member, whereby said drive gear is intermittently locked after each said incremental angular advancement of said roller member to prevent actuation of said toner transfer mechanism while said rotatable member rotates through said recesses at the second position thereof.

3. The toner container system of claim 2 wherein said locking mechanism is cam driven.

4. The toner container system of claim 1 wherein said plurality of recesses is 3, 4, 5, or 6 recesses.

5. The toner container system of claim 1 wherein each of said recesses is defined by a concave surface having a radius of curvature.

6. The toner container system of claim 5 wherein said roller member has as radius of curvature of from about 5 to about 15 mm.

7. The toner container system of claim 6 wherein said radius of curvature of each of said concave surfaces is in the range of from about 0.75 to about 3.0 times the radius of curvature of said roller member.

8. A system for transferring image forming material from a first reservoir to a second reservoir for use with an image forming apparatus, comprising:

a toner transfer mechanism including a generally cylindrically shaped rotatable roller member having a plurality of recesses disposed around the circumference thereof at equal angular increments, said roller member being rotatable in said angular increments whereby said recesses are alternately open to the first reservoir in a first position for each of said recesses and open to the second reservoir in a second position for each of said recesses, whereby toner is transferred from the first reservoir to the second reservoir upon rotation of said roller member;

a Geneva drive mechanism including a drive gear operatively connected to said roller member for rotatably advancing said roller member in one said angular increment for each complete rotation of said drive gear; and a rotatable member disposed within said second reservoir for removing toner from each of said recesses, said rotatable member being sized and operatively disposed to rotate through each of said recesses at the second position thereof in response to each incremental angular advancement of said roller member.

9. The system of claim 8 further comprising a locking mechanism operatively interconnecting said drive gear and said rotatable member, whereby said drive gear is intermittently locked after each said incremental angular advancement of said roller member to prevent actuation of said toner transfer mechanism while said rotatable member rotates through said recesses at the second position thereof.

10. The system of claim 9 wherein said locking mechanism is cam driven.

11. The system of claim 8 wherein said plurality of recesses is 3, 4, 5, or 6 recesses.

12. The system of claim 8 wherein each of said recesses is defined by a concave surface having a radius of curvature.

13. The system of claim 12 wherein said roller member has as radius of curvature of from about 5 to about 15 mm.

14. The system of claim 13 wherein said radius of curvature of each of said concave surfaces is in the range of from about 0.75 to about 3.0 times the radius of curvature of said roller member.

15. A toner container system for an image forming apparatus, comprising:

a housing comprising a first reservoir for containing toner and a second reservoir for receiving toner from said first reservoir; and a toner transfer mechanism disposed between said first reservoir and said second reservoir; said toner transfer mechanism including:

a generally cylindrically shaped rotatable roller member having a plurality of recesses disposed around the circumference thereof at equal angular increments, said roller member being rotatable in said angular increments whereby said recesses are alternately open to said first reservoir in a first position for each recess and open to said second reservoir in a second position for each recess, whereby toner is transferred from said first reservoir to said second reservoir upon rotation of said roller member;

a Geneva drive mechanism including a drive gear operatively connected to said roller member for rotatably advancing said roller member in one said angular increment for each complete rotation of said drive gear;

a rotatable member disposed within said second reservoir for removing toner from each of said recesses, said rotatable member being sized and operatively disposed to rotate through each of said recesses at the second position thereof in response to each incremental angular advancement of said roller member; and a locking mechanism operatively interconnecting said drive gear and said rotatable member, whereby said drive gear is intermittently locked after each said incremental angular advancement of said roller member to prevent actuation of said toner transfer mechanism while said rotatable member rotates through a recess of said recesses at the second position thereof.

16. The toner container system of claim 15 wherein said locking mechanism is cam driven.

17. The toner container system of claim 15 wherein said plurality of recesses is 3, 4, 5, or 6 recesses.

18. The toner container system of claim 15 wherein each of said recesses is defined by a concave surface having a radius of curvature.

19. The toner container system of claim 18 wherein said roller member has as radius of curvature of from about 5 to about 15 mm.

20. The toner container system of claim 19 wherein said radius of curvature of each of said concave surfaces is in the range of from about 0.75 to about 3.0 times the radius of curvature of said roller member.

21. The toner container system of claim 15 wherein said housing further comprises a first housing containing said first reservoir and a second housing containing said second reservoir with said toner transfer mechanism disposed in one of said first housing and said second housing and said first and second housings being detachably mounted to one another.

22. The toner container system of claim 15 wherein said housing further comprises a first housing containing said first reservoir and a second housing containing said second reservoir with said toner transfer mechanism disposed between said first housing and said second housing and said first and second housings being detachably mounted to said toner transfer mechanism.

* * * * *